US006679201B2

(12) United States Patent
Murakami et al.

(10) Patent No.: US 6,679,201 B2
(45) Date of Patent: Jan. 20, 2004

(54) ENGINE COOLING SYSTEM

(75) Inventors: Hiromichi Murakami, Nishikasugai (JP); Daisuke Yamamoto, Komaki (JP); Hiroshi Suwahara, Toyota (JP)

(73) Assignees: Aisan Kogyo Kabushiki Kaisha, Obu (JP); Toyota Jidosha Kabushiki Kaisha, Toyota (JP)

( * ) Notice: Subject to any disclaimer, the term of this patent is extended or adjusted under 35 U.S.C. 154(b) by 54 days.

(21) Appl. No.: 10/146,926

(22) Filed: May 17, 2002

(65) Prior Publication Data

US 2002/0189555 A1 Dec. 19, 2002

(30) Foreign Application Priority Data

Jun. 13, 2001 (JP) ..... 2001-178446

(51) Int. Cl.[7] ..... F01P 7/14
(52) U.S. Cl. ..... 123/41.1
(58) Field of Search ..... 123/41.02, 41.08, 123/41.09, 41.18, 41.15, 198 D

(56) References Cited

U.S. PATENT DOCUMENTS 4,577,594 A * 3/1986 Hayashi et al. ..... 123/41.08
5,522,350 A * 6/1996 Hollis ..... 123/41.1
5,924,412 A * 7/1999 Suzuki et al. ..... 123/41.08

FOREIGN PATENT DOCUMENTS

JP A 9-195768 7/1997

* cited by examiner

*Primary Examiner*—Henry C. Yuen
*Assistant Examiner*—Arnold Castro
(74) *Attorney, Agent, or Firm*—Oliff & Berridge, PLC

(57) ABSTRACT

An engine cooling system controls a cooling degree of an engine 1 according to an operating condition thereof by circulating cooling water through the engine. This system is provided with a flow rate regulating valve 8 for regulating a circulation flow rate of the cooling water. An electronic control unit (ECU) 30 controls the valve 8 to open at a predetermined opening when determining the engine 1 as being stopped. In this opening control, the ECU 30 controls to bring a valve element into contact with a valve body once and then move the valve element to determine the predetermined opening with reference to a full-closed position of the valve element.

20 Claims, 5 Drawing Sheets

ENGINE COOLING SYSTEM

BACKGROUND OF THE INVENTION

1. Field of the Invention

The present invention relates to an engine cooling system of a water-cooling type for cooling an engine by circulation of cooling water through the engine and, more particularly, to an engine cooling system which controls the degree of cooling the engine according to engine operating conditions.

2. Description of Related Art

In conventional mainstream cooling systems of a water-cooling type to be mounted in engines, regardless of operating conditions of the engines, cooling water is generally See controlled at a constant temperature of about 80° C. by means of a thermostat. However, changing the cooling degree according to the engine operating conditions (a loaded condition on an engine, engine rotational speed, etc.) has been proved effective in reducing engine friction, increasing fuel efficiency, and improving knocking performance, and so on. Hence there have been proposed some cooling systems of a water-cooling type configured to control the cooling degree according to the engine operating conditions.

One of such the cooling systems is disclosed in Japanese Patent Unexamined Publication No. 9-195768. This cooling system is arranged such that a valve element of a thermostat is controlled by an electromagnetic actuator to open/close and, when an engine is stopped, the electromagnetic actuator is operated to forcibly open the valve element if a temperature of engine cooling water is a predetermined set value or more. This is to prevent overheating of the cooling water at the engine stop.

In the cooling system disclosed in the above publication, however, the valve element is forced to open only in the event that the temperature of the engine cooling water is a predetermined set value or more. Although this could prevent the overheating of the cooling water during the engine stop, it would cause a problem in the serviceability to change the coolingwater. To be more specific, in the conventional cooling system, when the temperature of the cooling water is below the set value at the time the engine is stopped, the valve element is closed, which would stagnate the flow of the cooling water in a cooling-water passage. This makes it difficult to change the cooling water.

When the engine in operation is stopped, on the other hand, the engine remains in a high temperature state for a while. This may produce vapor in a circulation passage including the cooling-water passage, resulting in the accumulation of air. The conventional cooling system is configured to vent such the vapor out through an air vent device disposed in the circulation passage. However, the vapor can be vented through the air vent device only when the cooling water is permitted to circulate in the circulation passage. When the valve element is closed as above, therefore, it is difficult to vent the vapor.

SUMMARY OF THE INVENTION

The present invention has been made in view of the above circumstances and has an object to overcome the above problems and to provide an engine cooling system capable of producing a flow of cooling water in a circulation passage even after stop of an engine to improve workability to change the cooling water and of preventing the accumulation of air in a circulation passage which would caused by vapor occurring in the cooling water in a high temperature state.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided an engine cooling system which cools an engine by circulating cooling water in a circulation passage and controls a cooling degree of the engine according to an operating condition of the engine, the system including: a flow rate regulating valve for regulating a circulation flow rate of the cooling water; stop determining means for determining whether the engine is stopped; and after-engine-stop control means for controlling the flow rate regulating valve to open at a predetermined opening whenever the engine is determined as being stopped by the stop determining means.

According to the above structure, the opening degree of the flow rate regulating valve is controlled to regulate a flow rate of the cooling water circulating in the circulation passage, thereby adjusting the temperature of the cooling water, so that the cooling degree of the engine is efficiently controlled. Whenever the engine is stopped and the stop determining means determines as such, the after-engine-stop control means controls the flow rate regulating valve to open at the predetermined opening degree. Consequently, even after engine stop, the opening of the flow rate regulating valve allows a flow of the cooling water in the circulation passage. Furthermore, even if the engine is still in a high temperature state immediately after the stop and therefore vapor occurs in the cooling water, the vapor is allowed to flow.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of an engine cooling system embodying the present invention will now be given referring to the accompanying drawings.

Figure 1:
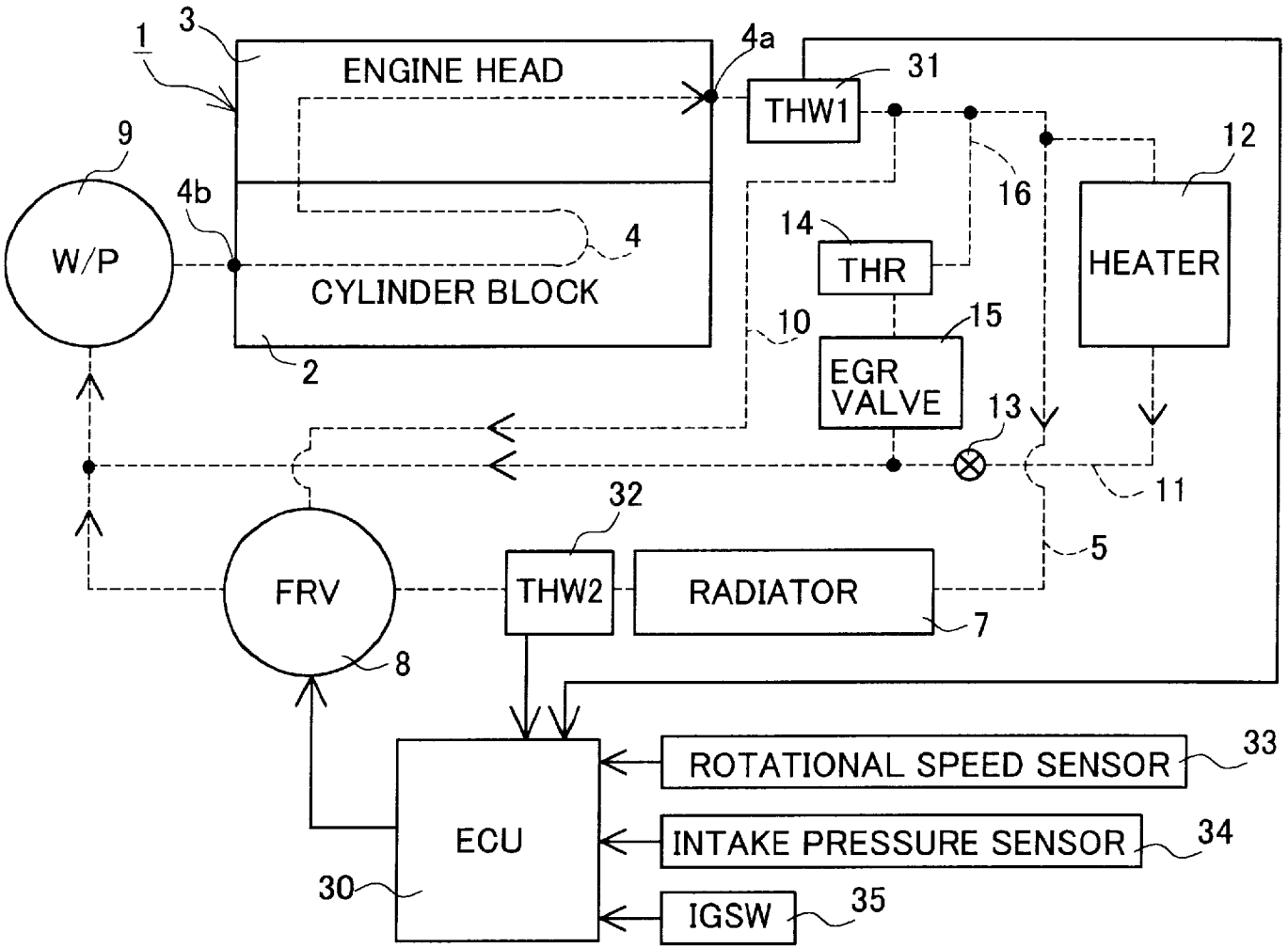
FIG. 1 is a schematic structural view showing an engine cooling system in an embodiment according to the present invention.

FIG. 1 shows a schematic structure of the engine cooling system in the present embodiment. An engine 1 mounted on a motor vehicle includes a cylinder block 2 and an engine head 3. This cooling system is to cool the engine 1 by circulating cooling water therein. The cylinder block 2 and the engine head 3 are provided with a cooling-water passage 4 including a water jacket and others.

The passage 4 is connected with a main piping line 5 disposed extending from an outlet 4*a* of the passage 4 to an inlet 4*b* of same to allow fluid communication from the outlet 4*a* to the inlet 4*b*. These passage 4 and the main line 5 and others constitute a circulation passage in which the cooling water is allowed to circulate. In the main line 5, in a direction from the outlet 4*a* side to the inlet 4*b* side, there are disposed a first temperature sensor 31, a radiator 7, a second temperature sensor 32, a flow rate regulating valve (FRV) 8, and a water pump (W/P) 9 in that order.

The first temperature sensor 31 is disposed adjacent to the outlet 4*a* and used to detect a temperature THW1 of the cooling water flowing out of the passage 4 of the engine 1, i.e. an engine outlet side water temperature. The radiator 7 dissipates the heat of the cooling water that absorbed from the engine 1. The second temperature sensor 32 is disposed adjacent to an outlet of the radiator 7 and used to detect a temperature THW2 of the cooling water flowing out of the radiator 7, i.e. a radiator outlet side water temperature. The flow rate regulating valve 8 is electrically controlled to regulate a flow rate of the cooling water circulating in the main line 5 and others. The water pump 9 is actuated by power derived from the engine 1 to produce a flow of the cooling water in the main line 5.

A bypass piping line 10 is arranged between a part of the main line 5 located downstream from the first temperature sensor 31 and the flow rate regulating valve 8. A heater piping line 11 is disposed between another part of the main line 5 located downstream from the first temperature sensor 31 and the water pump 9. In the heater line 11, there is provided a heater 12 for heating the interior of a motor vehicle by dissipating the heat of the cooling water flowing through the heater line 11. A shut-off valve 13 for interrupting the flow of the cooling water through the heater line 11 is also disposed in the line 11.

Between another part of_the main line 5 located downstream from the first temperature sensor 31 and the heater line 11, a cooling piping line 16 for cooling a throttle body (THR) 14 and an EGR valve 15 and other attachment devices respectively is arranged.

Figure 2:
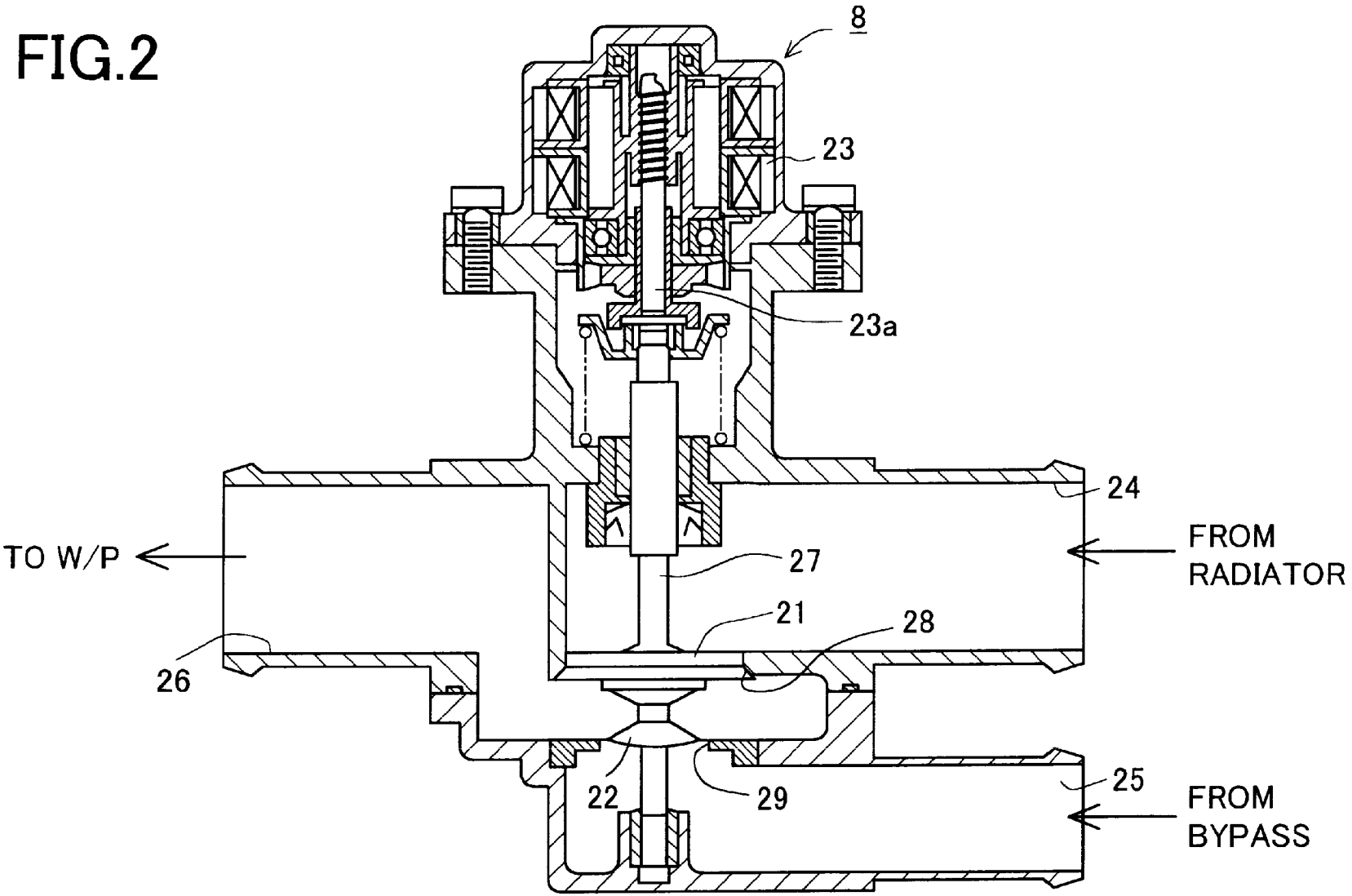
FIG. 2 is a sectional view of a flow rate regulating valve in the system.

FIG. 2 is a sectional view of the flow rate regulating valve 8. This valve 8 includes two valve elements 21 and 22 for regulating a flow rate of the cooling water in the main line 5 and the bypass line 10 respectively. The valve elements 21 and 22 are operated together by a stepper motor 23. The valve 8 is provided with a first inlet port 24, a second inlet port 25, and a single outlet port 26. The first inlet port 24 is connected with the main line 5 to guide the cooling water having flowed out of the radiator 7 into the valve 8. The second inlet port 25 is connected with the bypass line 10. The outlet port 26 is connected with the main line 5. The cooling water having flowed into the valve 8 through the first inlet port 24 and that through the second inlet port 25 are thus discharged together to the main line 5 through the port 26. The two valve elements 21 and 22 are mounted on a valve rod 27 extending from an output shaft 23*a* of the stepper motor 23. In FIG. 2, up-and-down, or axial, motions of the output shaft 23*a* cause simultaneous movement of the valve elements 21 and 22 with respect to a valve seat 28 and a valve port 29 respectively, thereby determining the opening degree of the valve 8.

Figure 3:
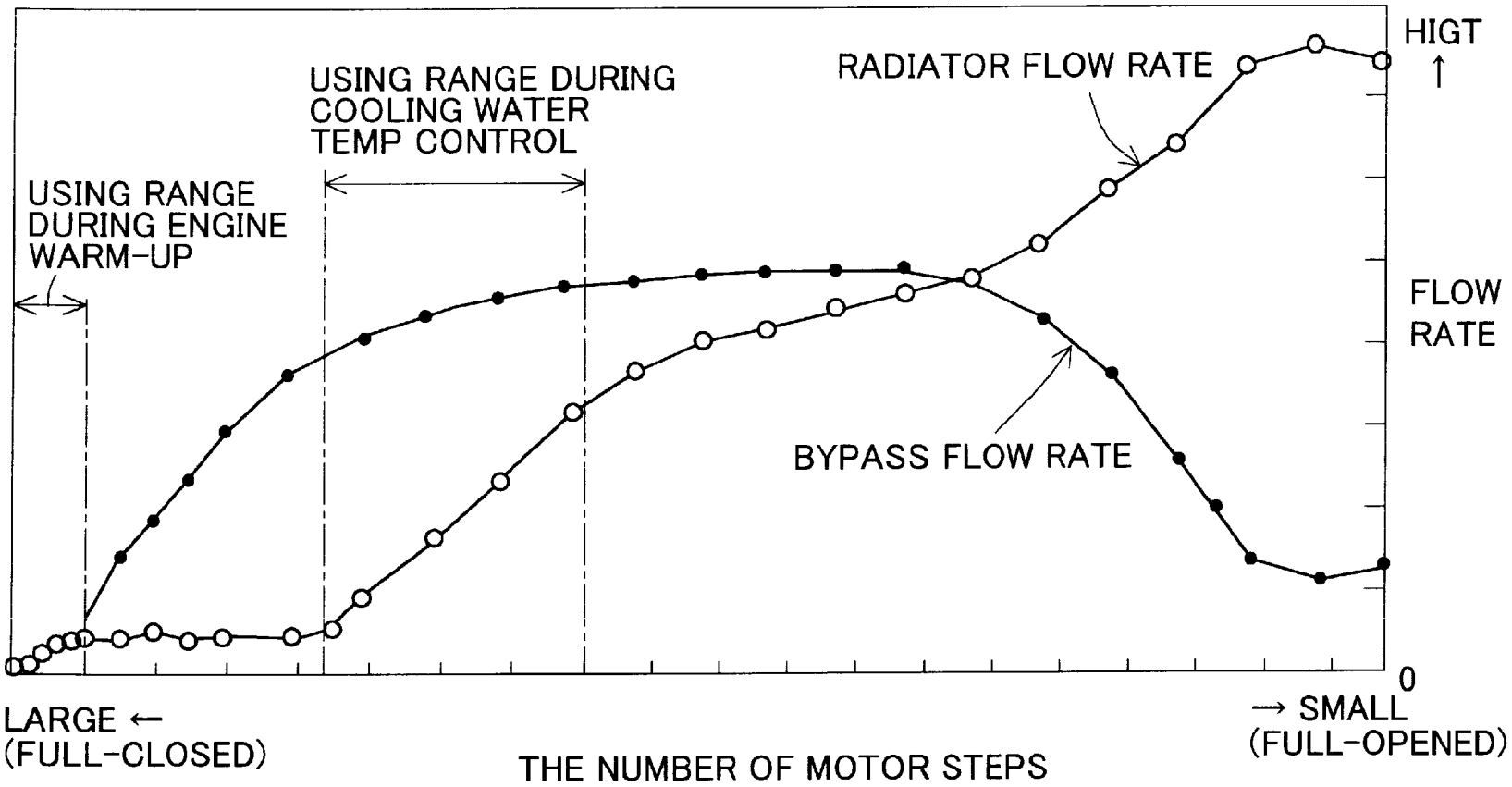
FIG. 3 is a graph showing a flow rate characteristic of the flow rate regulating valve.

FIG. 3 is a graph showing a flow rate characteristic of the flow rate regulating valve 8. In this graph, a lateral axis indicates the number of motor steps of the stepper motor 23 corresponding to a valve opening degree and a vertical axis indicates a flow rate of the cooling water. As clearly seen from this graph, a flow rate of the cooling water flowing through the main line 5 downstream from the radiator 7 (a radiator flow rate) gradually increases as the valve opening degree becomes larger. A flow rate of the coolingwater flowing through the bypass line 10 (a bypass flow rate) fluctuates with a peak as the valve opening degree is increased. In this flow rate characteristic, a small opening degree close to a full-closed position is used for warm-up of the engine 1; on the other hand, a middle opening degree is used for control of the temperature of the cooling water.

This cooling system is arranged to control the cooling degree of the engine 1 by controlling the flow rate regulating valve 8 according to the operating conditions of the engine 1 to regulate the flow rate of the cooling water circulating in the engine 1. The system therefore has an electronic control unit (ECU) 30 as shown in FIG. 1. With respect to the ECU 30, the first temperature sensor 31, the second temperature sensor 32, and the flow rate regulating valve 8 are connected respectively. Furthermore, a rotational speed sensor 33, an intake pressure sensor 34, and an ignition switch (IGSW) 35 are connected to the ECU 30 to obtain the operating conditions of the engine 1. The rotational speed sensor 33 detects an engine rotational speed NE and outputs a signal representing a detected value thereof. The intake pressure sensor 34 is disposed in an intake passage (not shown) in the engine 1. This sensor 34 detects an intake pressure PM reflecting the load on the engine land outputs a signal representing a detected value thereof. The ignition switch 35 is operated to start or stop the engine 1.

In the present embodiment, the ECU 30 is used to execute cooling water temperature control and corresponds to stop determining means and after-engine-stop control means in the present invention.

As is generally known, the ECU 30 includes a central processing unit (CPU), a read only memory (ROM), a random access memory (RAM), a backup RAM, an external input circuit, an external output circuit, etc. The ECU 30 in which the CPU, ROM, RAM, and backup RAM are connected to the external input circuit and the external output circuit by a bus constitutes a logic operation circuit. In the ROM, a predetermined control program in relation to the cooling water temperature control or the like is stored in advance. The RAM temporarily stores operation results by the CPU. The backup RAM saves previously stored data. The CPU executes the cooling water temperature control or the like in compliance with the predetermined control program in response to the detection signals input from the sensors 31 through 35 through the input circuit.

Figure 4:
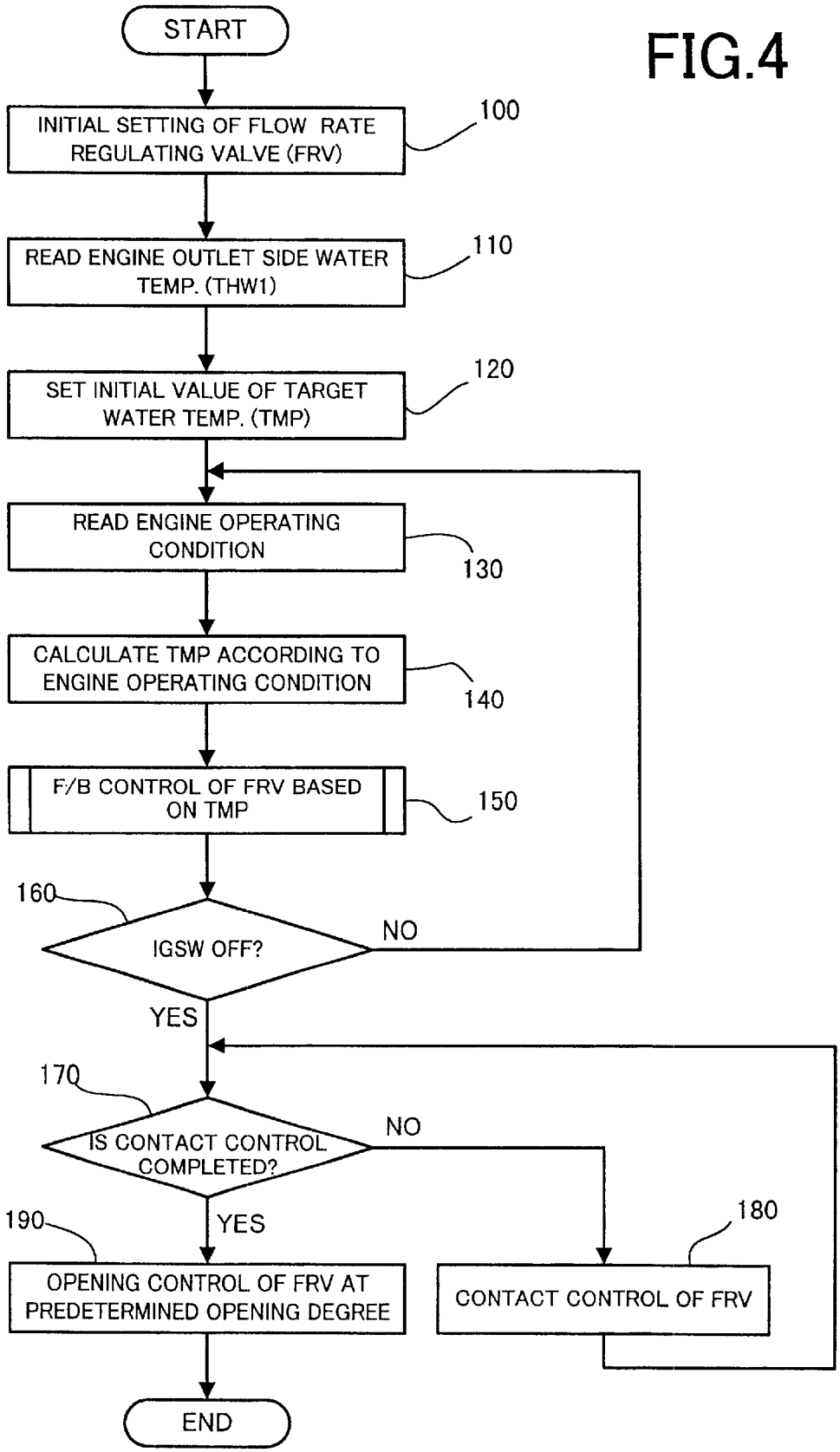
FIG. 4 is a flowchart showing a routine of cooling water control.

The contents of the cooling water temperature control to be executed by the CPU 30 is explained referring to FIG. 4 which is a flowchart showing a routine of the control.

Upon turn-on of the ignition switch 35, in step (hereinafter abbreviated as "S") 100, the ECU 30 makes initial settings such as ascertainment of an opening position of the flow rate regulating valve 8 (control to bring the valve element 21 into contact with the valve seat 28, which is referred to as "contact control" in the present embodiment), an A/D processing, and a reset of data in the RAM.

In S110, the ECU 30 reads a value of the engine outlet side water temperature THW1 detected by the first temperature sensor 31.

In S120, the ECU 30 sets an initial value of a target water temperature TMP according to the read engine outlet side water temperature THW1. This processing is to select the initial value of the target water temperature TMP from two values depending on whether the temperature THW1 is higher or lower than a reference temperature, for example, 100° C.

In S130, the ECU 30 reads values indicating the operating conditions of the engine 1. In the present embodiment, specifically, the ECU 30 reads each value of the engine rotational speed NE and the intake pressure PM detected by the rotational speed sensor 33 and the intake pressure sensor 34 respectively.

In S140, the ECU 30 calculates the target water temperature TMP corresponding to the operating conditions of the engine 1. More specifically, the ECU 30 calculates the target water temperature TMP based on the read values of the engine rotational speed NE and the intake pressure PM by reference to a water temperature map presenting predetermined functional data.

In S150, the ECU 30 executes a F/B control (fine control) on the opening degree of the flow rate regulating valve 8 based on the calculated value of the target water temperature TMP to bring the value of the engine outlet side water temperature THW1 close to the value of the target water temperature TMP.

In S160, subsequently, the ECU 30 determines whether the ignition switch (IGSW) 35 has been turned OFF. If a negative decision is made, the ECU 30 determines that the engine 1 is in operation and returns the flow to S130. If an affirmative decision is made in S160, alternatively, the ECU 30 determines that the engine 1 has been stopped and advances the flow to S170 to S190 for performing the control of the flow rate regulating valve 8 at the engine stop (which is referred to as "after-engine-stop control"). In order to ensure the processing in S170 through S190, a predetermined power source control circuit delays the shut-off of power to the ECU 30, the valve 8, and others by a predetermined time after the turn-off of the ignition switch 35.

In S170, the ECU 30 determines whether "contact control" has been completed. If a negative decision is made, the ECU 30 repeatedly effects the contact control of the flow rate regulating valve 8 in S180 until an affirmative decision is obtained in S170.

The "contact control" in the present embodiment means the control to confirm a full-closed position of the flow rate regulating valve 8 (the valve element 21). More specifically, in FIG. 2, the stepper motor 23 is actuated to move upward the valve rod 27 extending from the output shaft 23*a* of the motor 23 until the valve element 21 is brought into full contact with the valve seat 28. At this time, the number of operating steps of the stepper motor 23 needed for bringing the valve element 21 into contact with the valve seat 28 is recognized as a home position of the valve element 21 corresponding to the full-closed position.

If an affirmative decision is obtained in S170, alternatively, the ECU 30 controls the flow rate regulating valve 8 to open at a predetermined opening degree ("opening control") in S190 and terminates the processing. Supposing the full-opened position to be a 100% valve opening degree, the predetermined opening degree may be set to for example 50%.

It is to be noted that the state of the valve 8 shown in FIG. 2 in which the valve element 21 is in the full-closed position and the valve element 22 is in a substantial-closed position corresponds to a valve full-closed state. The valve element 22, having two substantial-closed positions, is brought to the other substantial-closed position when the valve element 21 is fully opened. When the valve element 21 is opened at a predetermined opening degree (e.g. 50%), furthermore, the valve element 22 is put in a full-opened position.

In the above routine, when determining the stop of the engine 1, the ECU 30 effects the opening control of the valve 8 at the predetermined opening degree. The valve 8 is controlled such that the valve element 21 is moved between the full-closed position in which the valve element 21 is in contact with the valve seat 28 and the predetermined full-opened position. Thus the ECU 30 brings the valve element 21 once into contact with the valve seat 28, namely, the full-closed position, and then moves the valve element 21 in reference to the full-closed position to determine the predetermined opening degree of the valve 8.

As explained above, according to the engine cooling system in the present embodiment, the opening degree of the flow rate regulating valve 8 is controlled by the ECU 30 to regulate the flow rate of the cooling water circulating in the engine 1 and others and simultaneously control the temperature of the cooling water, thereby controlling the cooling degree of the engine 1.

If the engine 1 is stopped and the ECU 30 determines as such, the valve 8 is always controlled by the ECU 30 to open at the predetermined opening degree. Accordingly, even after the engine stop, the opening of the valve 8 continuously allows a flow of the cooling water in the circulation passage including the coolant passage 4, the main line 5, and others. This makes it possible to easily discharge waste cooling water from the circulation passage as needed during a stopped condition of the engine 1 and then fill fresh cooling water to distribute the water throughout the circulation passage. Thus serviceability to change the cooling water can be improved. Even if the engine 1 immediately after stopped is still in a high temperature state and therefore vapor occurs, the vapor is allowed to flow through the circulation passage. As a result, the vapor can easily be purged through the air vent device normally disposed in the radiator 7 or the like. This can prevent the occurrence of air accumulation resulting from the vapor in the circulation passage.

Figure 5:
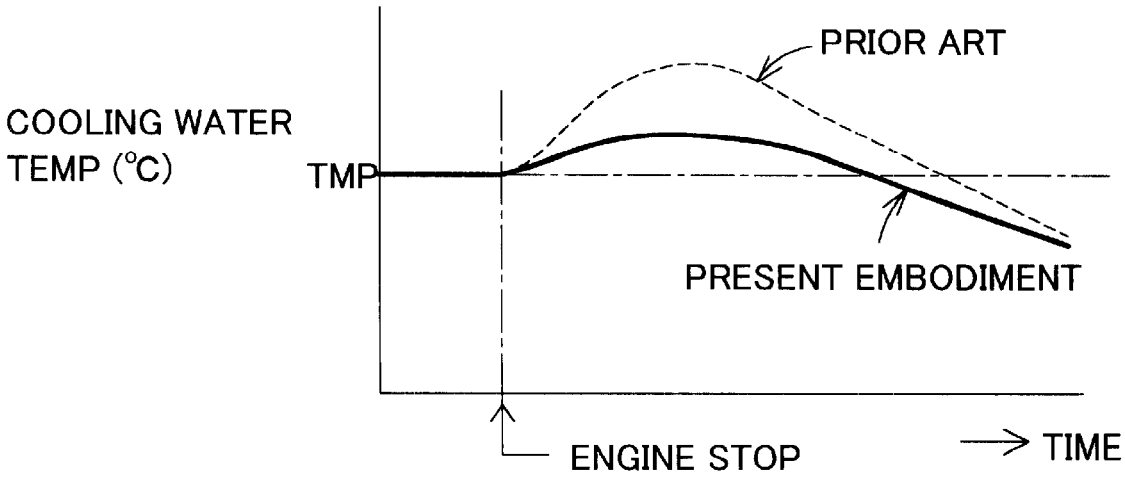
FIG. 5 is a time chart showing behavior of a cooling water temperature after engine stop.
Figure 6:
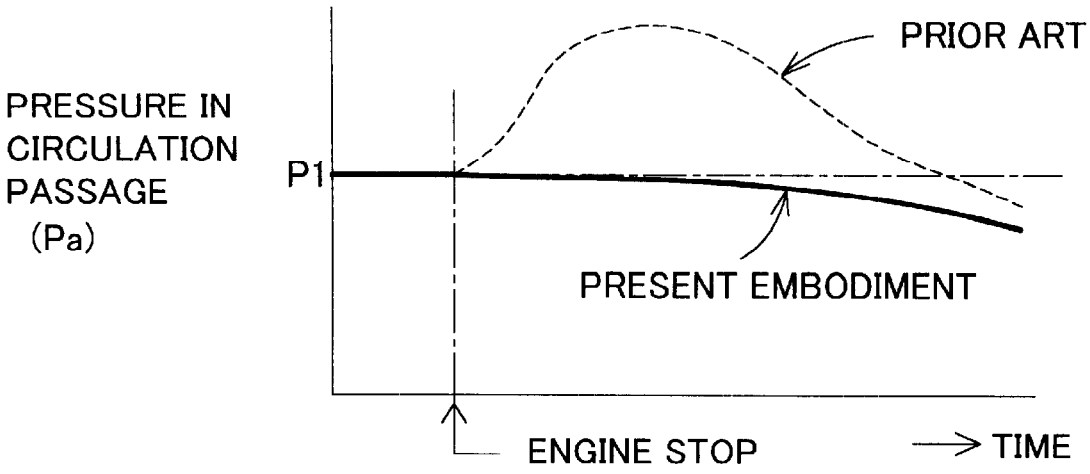
FIG. 6 is a time chart showing behavior of pressure in a circulation passage after the engine stop.

FIGS. 5 and 6 are graphs respectively showing behaviors of the temperature of the cooling water and the pressure in the circulation passage after the engine stop in the engine cooling system in the present embodiment. In the graphs, a solid line indicates a temperature change in the present embodiment in which the after-engine-stop control is executed and a broken line indicates a temperature change in a conventional system which does not execute the after-engine-stop control.

As seen in FIG. 5, the engine cooling system in the present embodiment could suppress a rise in temperature of the cooling water immediately after the engine stop as compared with the conventional system. From this point of view, it is assumed that the occurrence of vapor in the circulation passage is suppressed immediately after the engine stop. As seen in FIG. 6, furthermore, the engine cooling system in the present embodiment could suppress a rise in pressure in the circulation passage immediately after the engine stop as compared with the conventional system. This shows that no excessive pressure is applied to each component in the cooling system immediately after the engine stop.

According to the engine cooling system in the present embodiment, in the opening control of the flow rate regulating vale 8 by the ECU 30 after stop of the engine 1, the valve element 21 is moved in reference to the full-closed position in which the valve element 21 is in contact with the valve seat 28 and the predetermined opening degree is determined. Thus the valve 8 can surely be opened at the predetermined opening degree at every time. Consequently, the valve 8 can be prevented from closing unintentionally during the opening control. After the engine stop, the circulation passage can always provide a flow of the cooling water for a change thereof and a flow of the vapor for a purge thereof.

The present invention may be embodied in other specific forms without departing from the spirit or essential characteristics thereof. For instance, the following modifications may be adopted.

(1) The structure schematically shown in FIG. 1 is only one example of the engine cooling system of the invention. The invention may be embodied in an engine cooling system that does not include the cooling passage 16 and others for cooling the throttle body 14 and the EGR valve 15.

(2) In the above embodiment, when the engine 1 is stopped, the contact control of the flow rate regulating valve 8 is performed before the opening control thereof. This contact control may be omitted.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An engine cooling system which cools an engine by circulating cooling water in a circulation passage and controls a cooling degree of the engine according to an operating condition of the engine, the system including:

a flow rate regulating valve for regulating a circulation flow rate of the cooling water;

stop determining means for determining whether the engine is stopped; and after-engine-stop control means for controlling the flow rate regulating valve to open at a predetermined opening whenever the engine is determined as being stopped by the stop determining means.

2. The engine cooling system according to claim 1, wherein the flow rate regulating valve includes a valve element, a valve seat corresponding to the valve element, an actuator for moving the valve element with respect to the valve seat, the valve element is moved by operation of the actuator between a full-closed position in which the valve element is in full contact with the valve seat and a full-opened position in which the valve element is fully separated from the valve seat, and the after-engine-stop control means, when the engine is determined as being stopped by the stop determining means, controls the actuator to move the valve element with respect to the valve seat to determine the predetermined opening degree.

3. The engine cooling system according to claim 2 further including an ignition switch which is operated to selectively start and stop the engine, wherein the stop determining means determines that the engine is stopped at the time when the ignition switch is turned off.

4. The engine cooling system according to claim 3, wherein the full-opened position corresponds to a 100% opening of the flow rate regulating valve, the full-closed position corresponds to a 0% opening, and the predetermined opening degree is a 50% opening with respect to the 100% opening.

5. The engine cooling system according to claim 3 further including cooling control means for controlling the cooling degree of the engine, wherein the cooling control means controls the actuator of the flow rate regulating valve according to the operating condition of the engine to move the valve element for regulation of the circulation flow rate of the cooling water.

6. The engine cooling system according to claim 3, wherein the engine includes a cylinder block and an engine head both of which include a cooling-water passage including a water jacket, and the cooling-water passage is provided with an outlet and an inlet each of which is connected with a main piping line, the main piping line includes a radiator, the flow rate regulating valve, and a water pump, which are disposed at predetermined positions respectively in the line, the circulation passage includes the cooling-water passage and the main piping line, and the water pump when actuated produces a flow of the cooling water in the main piping line to cause circulation of the cooling water through the cooling-water passage and the main piping line.

7. The engine cooling system according to claim 6 further including:

water temperature detection means which is disposed at an adjacent position to the outlet of the cooling-water passage and detects a temperature of the cooling water flowing out of the cooling-water passage;

operating condition detection means which detects the operating condition of the engine; and cooling control means which controls the cooling degree of the engine by calculating a target water temperature according to the detected engine operating condition and feedback controlling the opening of the flow rate regulating valve based on the calculated target water temperature to bring the outlet side water temperature close to the target water temperature.

8. The engine cooling system according to claim 7, wherein the stop determining means, the after-engine-stop control means, and the cooling control means are constituted of an electronic control unit including a central processing unit, a memory, an external input circuit, and an external output circuit.

9. The engine cooling system according to claim 6 further including a by pass piping line disposed providing communication between a part of the main piping line positioned adjacent to the outlet of the cooling-water passage and the flow rate regulating valve, wherein the valve element includes a first valve element for regulating a flow rate of the cooling water flowing through the main piping line and a second valve element for regulating a flow rate of the cooling water flowing through the bypass piping line, and the valve seat includes a first valve seat corresponding to the first valve element and a second valve seat corresponding to the second valve element, the first and second valve elements being moved simultaneously by operation of the actuator with respect to the corresponding first and second valve seats so that the first valve element is moved between a full-closed position in which the first valve element is in full contact with_the first valve seat and a full-opened position in which the valve element is fully separated from the first valve seat and the second valve element is moved between two closed positions in which the second valve element is in substantial contact with the second valve seat, the second valve element being fully opened at a predetermined position between the two closed positions.

10. The engine cooling system according to claim 9, wherein the full-opened position of the first valve element with respect to the first valve seat corresponds to a 100% opening and the full-closed position of the same corresponds to a 0% opening, and the predetermined opening degree is a 50% opening with respect to the 100% opening.

11. The engine cooling system according to claim 10 further including cooling control means for controlling the cooling degree of the engine, wherein the cooling control means controls the actuator of the flow rate regulating valve according to the operating condition of the engine to move the first and second valve elements for regulation of the circulation flow rate of the cooling water.

12. The engine cooling system according to claim 1, wherein the flow rate regulating valve includes a valve element, a valve seat corresponding to the valve element, an actuator for moving the valve element with respect to the valve seat, the valve element is moved by operation of the actuator between a full-closed position in which the valve element is in full contact with the valve seat and a full-opened position in which the valve element is fully separated from the valve seat, and the after-engine-stop control means controls the actuator to move the valve element to the full-closed position so that the valve element is brought into contact with the valve seat once and then move the valve element toward the full-opened position with reference to the full-closed position to determine the predetermined opening degree.

13. The engine cooling system according to claim 12 further including an ignition switch which is operated to selectively start and stop the engine, wherein the stop determining means determines that the engine is stopped at the time when the ignition switch is turned off.

14. The engine cooling system according to claim 13, wherein the full-opened position corresponds to a 100% opening of the flow rate regulating valve, the full-closed position corresponds to a 0% opening, and the predetermined opening degree is a 50% opening with respect to the 100% opening.

15. The engine cooling system according to claim 13 further including cooling control means for controlling the cooling degree of the engine, wherein the cooling control means controls the actuator of the flow rate regulating valve according to the operating condition of the engine to move the valve element for regulation of the circulation flow rate of the cooling water.

16. The engine cooling system according to claim 13, wherein the engine includes a cylinder block and an engine head both of which include a cooling-water passage including a water jacket, and the cooling-water passage is provided with an outlet and an inlet each of which is connected with a main piping line, the main piping line includes a radiator, the flow rate regulating valve, and a water pump, which are disposed at predetermined positions respectively in the line, the circulation passage includes the cooling-water passage and the main piping line, and the water pump when actuated produces a flow of the cooling water in the main piping line to cause circulation of the cooling water through the cooling-water passage and the main piping line.

17. The engine cooling system according to claim 16 further including:

water temperature detection means which is disposed at an adjacent position to the outlet of the cooling-water passage and detects a temperature of the cooling water flowing out of the cooling-water passage;

operating condition detection means which detects the operating condition of the engine; and cooling control means which controls the cooling degree of the engine by calculating a target water temperature according to the detected engine operating condition and feedback controlling the opening of the flow rate regulating valve based on the calculated target water temperature to bring the outlet side water temperature close to the target water temperature.

18. The engine cooling system according to claim 17, wherein the stop determining means, the after-engine-stop control means, and the cooling control means are constituted of an electronic control unit including a central processing unit, a memory, an external input circuit, and an external output circuit.

19. The engine cooling system according to claim 16, further including a bypass piping line disposed providing communication between a part of the main piping line positioned adjacent to the outlet of the cooling-water passage and the flow rate regulating valve, wherein the valve element includes a first valve element for regulating a flow rate of the cooling water flowing through the main piping line and a second valve element for regulating a flow rate of the cooling water flowing through the bypass piping line, the valve seat includes a first valve seat corresponding to the first valve element and a second valve seat corresponding to the second valve element, the first and second valve elements being moved simultaneously by operation of the actuator with respect to the corresponding first and second valve seats so that the first valve element is moved between a full-closed position in which the first valve element is in full contact with the first valve seat and a full-opened position in which the valve element is fully separated from the first valve seat and the second valve element is moved between two closed positions in which the second valve element is in substantial contact with the second valve seat, the second valve element being fully opened at a predetermined position between the two closed positions.

20. The engine cooling system according to claim 19, wherein the full-opened position of the first valve element with respect to the first valve seat corresponds to a 100% opening and the full-closed position of the same corresponds to a 0% opening, and the predetermined opening degree is a 50% opening with respect to the 100% opening.

* * * * *